US005092693A

United States Patent [19]

Uchimura

[11] Patent Number: 5,092,693

[45] Date of Patent: Mar. 3, 1992

[54] PRINT HEAD MOUNTING MECHANISM FOR PRINTER

[75] Inventor: Hirozi Uchimura, Kawasaki, Japan

[73] Assignee: Fujitsu Limited, Kanagawa, Japan

[21] Appl. No.: 611,561

[22] Filed: Nov. 13, 1990

[30] Foreign Application Priority Data

Nov. 20, 1989 [JP] Japan ..... 1-301015

[51] Int. Cl.[5] ..... B41J 3/12

[52] U.S. Cl. ..... 400/175; 400/320

[58] Field of Search ..... 400/139, 140, 141, 175, 400/320, 679, 692, 124

[56] References Cited

U.S. PATENT DOCUMENTS

| | | | |
|---|---|---|---|
| 3,960,255 | 6/1976 | Bisson et al. | 400/175 |
| 4,229,114 | 10/1980 | Van Horne | 400/692 |
| 4,239,402 | 12/1980 | Jung et al. | 400/175 |
| 4,452,542 | 6/1984 | Akazawa | 400/175 |
| 4,534,287 | 8/1985 | Meloni | 400/320 |
| 4,576,496 | 3/1986 | Schwarz et al. | 400/320 |
| 4,708,502 | 11/1987 | Murakami | 400/175 |

FOREIGN PATENT DOCUMENTS

| | | | |
|---|---|---|---|
| 59-224380 | 12/1984 | Japan . | |
| 58758 | 3/1986 | Japan | 400/175 |
| 53040 | 3/1988 | Japan | 400/175 |
| 1-301350 | 12/1989 | Japan . | |

OTHER PUBLICATIONS

IBM Technical Disc. Bulletin, vol. 27, No. 2, Jul. 1984, "Adjustable Printhead Mount".

*Primary Examiner*—Edgar S. Burr
*Assistant Examiner*—Ren Yan
*Attorney, Agent, or Firm*—Armstrong, Nikaido, Marmelstein, Kubovcik & Murray

[57] ABSTRACT

A print head mounting mechanism for a printer is disclosed by which positioning of a print head in the forward and backward directions, leftward and rightward directions, and upward and downward directions with respect to a carrier can be achieved readily. The mounting mechanism includes a print head mounting plate secured in an integrated relationship to the carrier and having a predetermined thickness. The print head mounting plate has a U-shaped recess having a predetermined width and a predetermined depth. A mounting section for fitting in the U-shaped recess is provided on the print head. The print head is mounted on the carrier in an accurately positioned condition by fitting the print head mounting section into the U-shaped recess and urging the print head in the rearward direction and also in the downward direction by a wire spring.

5 Claims, 4 Drawing Sheets

PRINT HEAD MOUNTING MECHANISM FOR PRINTER

BACKGROUND OF THE INVENTION

This invention relates to a print head mounting mechanism for a printer for removably mounting a print head on a carrier of a printer.

Since a print head is one of most consuming parts among various parts composing a printer and consumption thereof has a direct influence on print quality, it often becomes necessary to exchange a print head. Accordingly, it is necessary for a mounting mechanism for a print head to be constructed such that a print head can be mounted on a carrier and exchanged readily.

An exemplary one of conventional mounting mechanisms for a print head will be described with reference to FIGS. 1 and 2. FIG. 1 shows general construction of a conventional print head mounting mechanism for mounting a print head 1 of a wire dot printer on a carrier or carriage 2, and FIG. 2 is a perspective view of the print head 1. The print head 1 is secured to the carrier 2 by means of a plurality of screws 3. However, when the print head 1 is to be secured, the distance t between a platen roll 4 and the print head 1 must be set to a predetermined dimension accurately. Thus, a pair of positioning stoppers 5 for contacting with each other to position the carrier 2 and the print head 1 relative to each other are formed on the carrier 2 and the print head 1, and while the stoppers 5 are held in contact with each other, the screws 3 are tightened to mount the print head 1 at a predetermined location of the carrier 2.

However, such operation of contacting the stoppers 5 with each other is performed by manual operation, and in a step of tightening the screws 3 while holding the stoppers 5 in contact with each other relying upon tact of an operator, the manner in which the stoppers 5 are contacted with each other sometimes varies among different operators. Consequently, the distance t between the platen roll 4 and the print head 1 may not become equal to the predetermined dimension, which may make a cause of deterioration in print quality. Further, there is another drawback that a mounting operation of a print head requires a tool such as a screw driver and besides much time is required for an exchanging operation of the print head 1.

SUMMARY OF THE INVENTION

Accordingly, it is an object of the present invention to provide a print head mounting mechanism for a printer by which, eliminating such drawbacks of conventional print head mounting mechanisms as described above, a print head can be mounted accurately at a predetermined location of a carrier and besides mounting and removing operations of the print head can be performed readily in a short period of time without using a tool.

In accordance with an aspect of the present invention, there is provided a print head mounting mechanism for a printer for removably mounting a print head on a carrier of the printer, which comprises a print head mounting plate secured in an integrated relationship on the carrier and having a predetermined thickness, the print head mounting plate having a U-shaped recess having a predetermined width and a predetermined depth, a generally H-shaped mounting section formed in an integrated relationship on the print head, the mounting section including first and second cross members and a central member interconnecting the first and second cross members, the distance between an inner face of the first cross member and an inner face of the second cross member being set greater than the thickness of the print head mounting plate, the width of the central member being set a little smaller than the width of the U-shaped recess, and first urging means for urging, when the central member of the print head is fitted in the recess of the print head mounting plate, the print head in a downward direction and also in a rearward direction in which the print head is moved away from a platen of the printer.

With the mounting mechanism of the present invention, the print head is positioned in the leftward and rightward directions with respect to the carrier as the central member of the print head is fitted in the U-shaped recess of the print head mounting plate; the print head is positioned in the upward and downward directions as a bottom face of the central member is contacted with a bottom face of the U-shaped recess; and the print head is positioned in the forward and rearward directions as the inner face of the first cross member is contacted with a surface of the print head mounting plate. Accordingly, accurate positioning of the print head in all of the three directions perpendicular to each other is assured, and consequently, the print head can be mounted accurately at a predetermined position.

The above and other objects, features and advantages of the present invention and the manner of realizing them will become more apparent, and the invention itself will best be understood, from a study of the following description and appended claims with reference had to the attached drawings showing some preferred embodiments of the invention.

DESCRIPTION OF THE PREFERRED EMBODIMENTS

Figure 1:
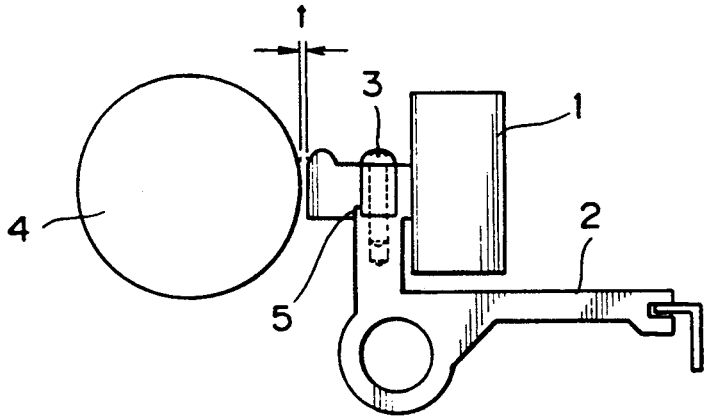
FIG. 1 PRIOR ART
FIG. 1 is a side elevational view of a conventional print head mounting mechanism.
Figure 2:
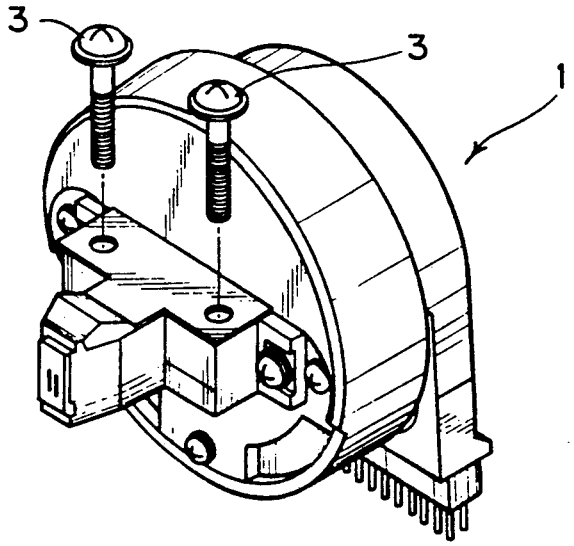
FIG. 2 PRIOR ART
FIG. 2 is a perspective view of a conventional print head.
Figure 3:
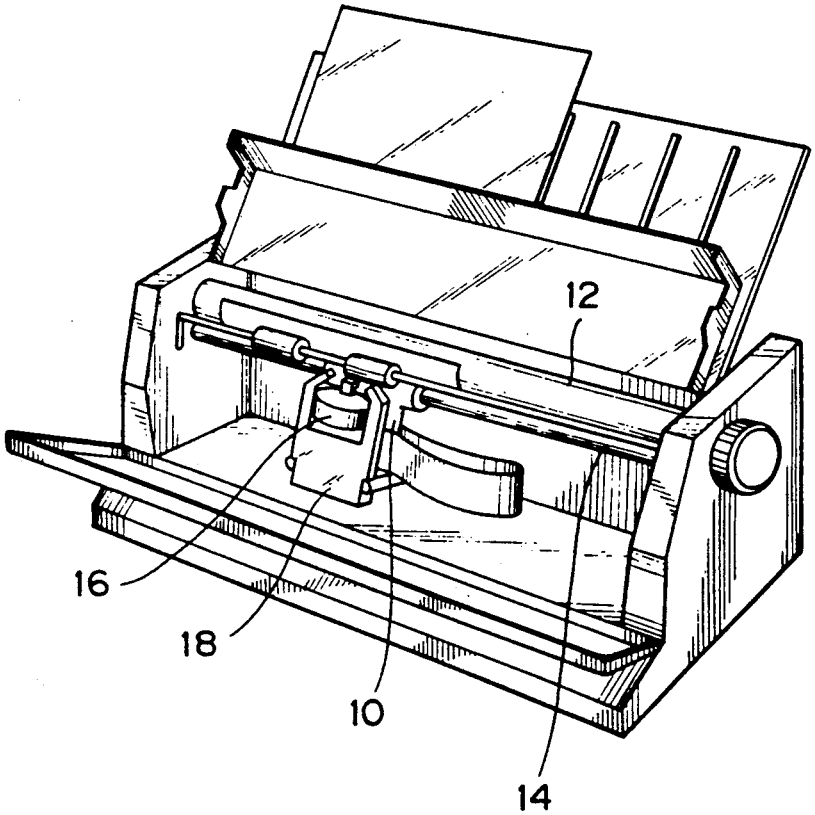
FIG. 3 is a perspective view of a wire dot printer to which a print head mounting mechanism of the present invention is suitably applied.

First, general construction of a wire dot printer to which a print head mounting mechanism of the present invention is suitably applied will be described with reference to FIG. 3. A carrier or carriage 10 is moved along a stay shaft 14 in a direction parallel to an axis of a platen roll 12 by a spacing motor not shown. A wire dot print head 16 is removably mounted on the carrier 10 in an opposing relationship to the platen roll 12. Further, a ribbon cassette 18 is removably mounted on the carrier 10.

Figure 4:
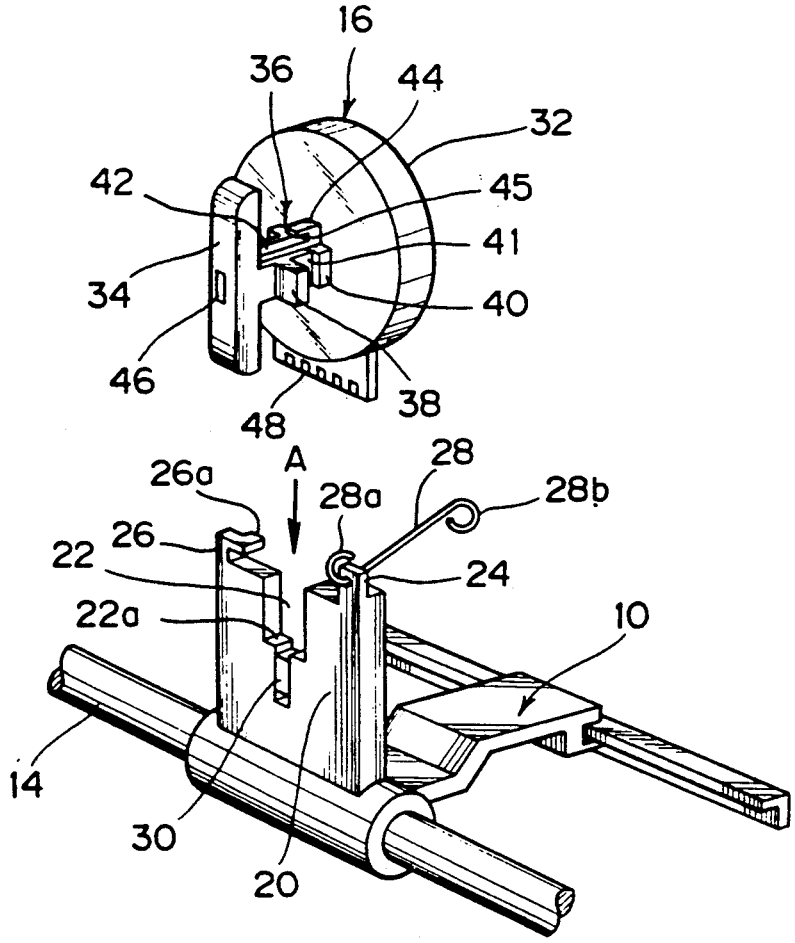
FIG. 4 is a perspective view of an embodiment of the present invention showing a print head removed from a carrier.

Referring now to FIG. 4, the print head 16 is shown in a condition removed from the carrier 10. A print head mounting plate 20 for mounting the print head 16 thereon is provided uprightly in an integrated relationship on the carrier 10, and a U-shaped mounting recess 22 is formed at the center of an upper portion of the print head mounting plate 20. A pair of projections 24 and 26 are formed in an integrated relationship on the opposite sides of an upper end portion of the print head mounting plate 20. A hole is formed in the projection 24, and an end 28*a* of a metal wire spring 28 made of, for example, stainless steel which is bent in a J-shape is anchored loosely for rocking motion in the hole of the projection 24. The other end side 28*b* of the wire spring 28 is formed in an annular ring such that it may be picked by fingers while an L-shaped ear 26*a* is formed in an integrated relationship on the other projection 26 so that it may be engaged with a portion of the wire spring 28 near the end portion 28*b*. Further, a leaf spring 30 is mounted on a wall portion of the print head mounting plate 20 which defines a bottom face 22*a* of the mounting recess 22.

Meanwhile, the print head 16 is composed of a body 32 and a nose 34 which are interconnected in an integrated relationship by an H-shaped mounting section 36. The mounting section 36 is composed of a first cross member 38 and a second cross member 40 connected in an integrated relationship to each other by a central member 44, and a pair of substantially U-shaped grooves 41 are defined between the first and second cross members 38 and 40. The width of the central member 44 is set a little smaller than the width of the mounting recess 22 formed in the print head mounting plate 20, and the distance between an inner face (rear face) of the first cross member 38 and an inner face (front face) of the second cross member 40 is set greater than the thickness of the print head mounting plate 20. A projection 44 is formed in an integrated relationship on a portion of the central member 42 adjacent the body 32, and a horizontal groove 45 is defined between the central member 42 and the projection 44.

An opening 46 through which a plurality of wires accommodated in the body 32 and central member 42 are to be projected is formed in the nose 34 of the print head 16. For example, 24 wires are accommodated in the print head 16, and the wires are selectively projected through the opening 46 to collide with the platen roll 12 with an ink ribbon interposed therebetween to effect printing in accordance with known technology. Reference numeral 48 denotes an electric connector.

The print head 16 is mounted in a predetermined positional relationship onto the carrier 10 by moving the print head 16 in the direction indicated by an arrow mark A in FIG. 4 until the central member 42 of the mounting section 36 is fitted into the mounting recess 22 formed in the print head mounting plate 20 of the carrier 10.

A condition wherein the print head 16 is mounted on the print head mounting plate 20 of the carrier 10 will be described with reference to FIGS. 5 to 7. The central member 42 of the mounting section 36 is first fitted into the mounting recess 22 of the print head mounting plate 20 such that the first and second cross members 38 and 40 of the print head 16 may hold the print head mounting plate 20 therebetween. Then, the end 28*b* of the wire spring 28 is picked up with fingers and threaded through the horizontal groove 45, and then the end 28*b* of the wire spring 28 is engaged with the ear 26*a* of the projection 26. By fitting the central member 42 of the mounting section 36 into the mounting recess 22 of the print head mounting plate 20 in this manner, the print head 16 is positioned in leftward and rightward directions with respect to the carrier 10.

Figure 5:
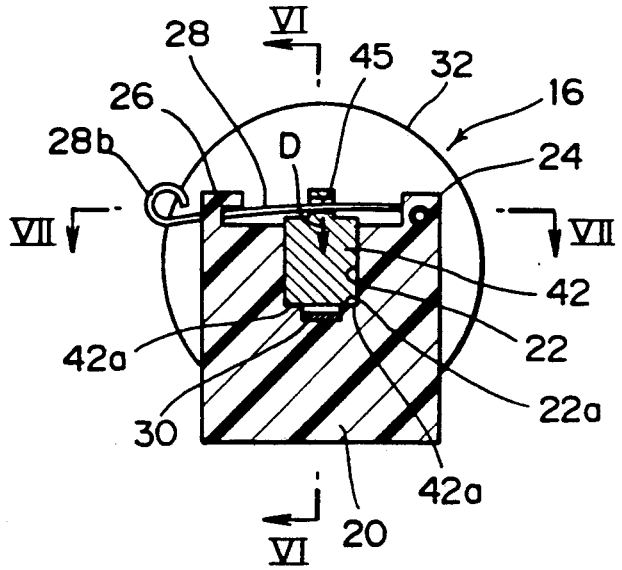
FIG. 5 is a sectional view taken along line V—V of FIG. 6 and showing the print head mounted on the carrier of FIG. 4.

As shown in FIG. 5, since the horizontal groove 45 of the print head 16 is located a little above a straight extending route of the wire spring 28, the wire spring 28 is put in a moderately curved condition in upward and downward directions due to engagement thereof with the horizontal groove 45 so that the print head 16 is now urged in the downward direction (in the direction indicated by an arrow mark D) by the wire spring 28. As a result, the bottom face 22*a* of the mounting recess 22 and a lower face 42*a* of the central member 42 of the print head 16 are contacted with each other thereby to position the print head 16 in the upward and downward directions with respect to the carrier 10.

Figure 7:
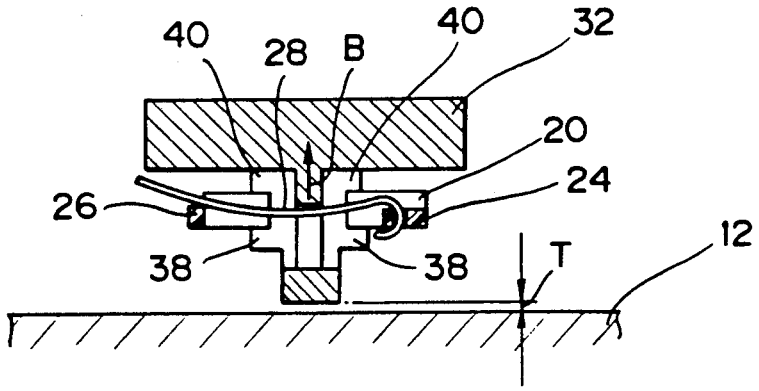
FIG. 7 is a sectional view taken along line VII—VII of FIG. 5.

Further, as shown in FIG. 7, since a rear face of the horizontal groove 45 of the print head 16 is located a little forwardly of the straight extending route of the wire spring 28, the wire spring 28 is put in a moderately curved condition in forward and backward directions due to engagement thereof with the horizontal groove 45 so that the print head 16 is now urged in the rearward direction (in the direction indicated by an arrow mark B). As a result, an inner face (rear face) of the first cross member 38 composing the mounting section 36 of the print head 16 and a front face of the print head mounting plate 20 are contacted with each other thereby to effect positioning of the print head 16 in the forward and backward directions with respect to the carrier 10.

Figure 6:
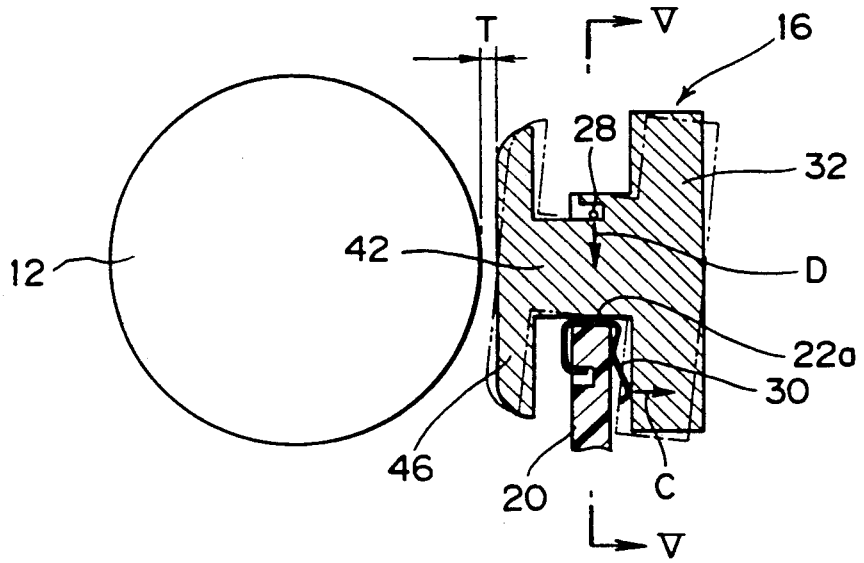
FIG. 6 is a sectional view taken along line VI—VI of FIG. 5.

However, if only urging force of the wire spring 28 acts upon the print head 16, then the print head 16 may be inclined upwardly as indicated in phantom in FIG. 6. In order to prevent this, the leaf spring 30 for urging the print head 16 in the rearward direction (in the direction indicated by an arrow mark C) is mounted on a bottom portion of the carrier 10 which defines the mounting recess 22. Accordingly, the print head 16 is put in a condition in which an upper portion thereof is urged in the rearward direction by the wire spring 28 and a lower portion thereof is urged in the rearward direction by the leaf spring 30. Consequently, the print head 16 is mounted on the carrier 10 without being inclined at all.

The print head 16 is secured to a predetermined location of the carrier 10 with respect to the leftward and rightward directions, upward and downward directions, and forward and backward directions in this manner, and the distance T (FIG. 6) between the print head 16 and the platen roll 12 and so forth are set accurately in a predetermined condition without the necessity of any adjusting operation.

It is to be noted that, when the print head 16 is to be removed from the carrier 10, only the end 28*b* of the wire spring 28 should be picked up with fingers to disengage the wire spring 28 from the ear 26*a* and the horizontal groove 45. After the wire spring 28 is disengaged, the print head 16 can be removed readily by pulling up the same.

According to the print head mounting mechanism for a printer of the present invention described in detail above, since positioning of a print head in forward and backward directions, leftward and rightward directions, and upward and downward directions with respect to a carrier can be achieved readily due to specific structure which employs a U-shaped mounting recess and a wire spring, the print head can be mounted at a predetermined location of the carrier readily in a short period of time without using a tool or the like.

What is claimed is:

1. A print head mounting mechanism for a printer for removably mounting a print head on a carrier of the printer, comprising:

a print head mounting plate secured in an integrated relationship on said carrier and having a predetermined thickness, said print head mounting plate having, a U-shaped recess having a predetermined width and a predetermined depth and upwardly extending projections at the opposite sides of said U-shaped recess:

a generally H-shaped mounting section integrally formed on said print head, said mounting section including first and second cross members and a central member interconnecting said first and second cross members and having top and bottom surfaces, the distance between an inner face of said first cross member and an inner face of said second cross member being greater than the thickness of said print head mounting plate, the width of said central member being smaller than the width of said U-shaped recess, said central member having a projection extending upwardly and bent forwardly toward said print head, said forwardly extending portion of said projection being spaced from said top surface of said central member and forming an open ended groove with said top surface of said central member; and first urging means pivotally fixed to one of said projections on said print head mounting plate and engageable with said central member and with the other of said projections for urging said print head in downward and rearward directions, when said central member of said print head is fitted in said recess of said print head mounting plate and said first urging means is in engagement with said central member and the other of said projections for moving said print head away from a platen of said printer.

2. A print head mounting mechanism according to claim 1, wherein said print head is positioned in the leftward and rightward directions with respect to said carrier by fitting said central member of said print head in said U-shaped recess of said print head mounting plate; said print head is positioned in the upward and downward directions by contact of said bottom surface of said central member with a bottom face of said U-shaped recess; and said print head is positioned in the forward and rearward directions by contact of an inner face of said first cross member with a surface of said print head mounting plate.

3. A print head mounting mechanism according to claim 2, wherein said first urging means is a wire spring having an end anchored to said one of said projections on said print head mounting plate and said wire spring extends through said groove on said top surface of said central member and the other end thereof engages said other of said projections on said printing head mounting plate and to normally urge said print head in said downward and rearward directions.

4. A print head mounting mechanism according to claim 2, further comprising second urging means for urging a lower portion of said print head in the rearward direction.

5. A print head mounting mechanism according to claim 4, wherein said second urging means is a leaf spring fitted on a bottom wall of said U-shaped recess of said print head mounting plate.

* * * * *